US007988257B2

(12) United States Patent
Jung et al.

(10) Patent No.: US 7,988,257 B2
(45) Date of Patent: Aug. 2, 2011

(54) INK CARTRIDGE, IMAGE FORMING APPARATUS, AND METHOD TO MANUFACTURE INK CARTRIDGE

(75) Inventors: Myung-song Jung, Gunpo-si (KR); Chang-shin Park, Seongnam-si (KR); Tae-kyun Kim, Seongnam-si (KR); Jae-cheol Lee, Hwaseong-si (KR); Dong-hwan Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 478 days.

(21) Appl. No.: 12/239,913

(22) Filed: Sep. 29, 2008

(65) Prior Publication Data

US 2009/0195578 A1 Aug. 6, 2009

(30) Foreign Application Priority Data

Feb. 5, 2008 (KR) ..... 10-2008-0011959

(51) Int. Cl.
*B41J 2/15* (2006.01)
*B41J 29/38* (2006.01)
*B41J 2/175* (2006.01)

(52) U.S. Cl. ..... 347/40; 347/12; 347/86

(58) Field of Classification Search ..... 347/12, 347/40–42, 86
See application file for complete search history.

(56) References Cited

U.S. PATENT DOCUMENTS 5,625,391 A * 4/1997 Hirabayashi et al. ..... 347/41
6,164,745 A * 12/2000 Nagoshi et al. ..... 347/15
2006/0132519 A1 6/2006 Kovacs

FOREIGN PATENT DOCUMENTS

JP 2003182142 7/2003

* cited by examiner

*Primary Examiner* — An H Do
(74) *Attorney, Agent, or Firm* — Stanzione & Kim, LLP

(57) ABSTRACT

An ink cartridge to prevent image degradation due to a misalignment of nozzles in a transfer direction of a printing medium and a transverse direction includes a print head substrate, a first head unit including at least one first print head chip which is disposed on the print head substrate and includes a plurality of first nozzles arranged in plural lines in a second direction perpendicular to a first direction which is a transfer direction of a printing medium, thereby forming a first line in the second direction, and a second head unit including at least one second print head chip which is disposed on the print head substrate and which has an ink jetting area overlapping a predetermined area of the first line, thereby forming an overlapping area, and which includes a plurality of second nozzles arranged in plural lines in the second direction, thereby forming a second line spaced from the first line, and dots formed by the first and the second nozzles, which neighbor each other in the overlapping area when jetting ink, have a gap with respect to the first and the second directions within a range satisfying the following equation:

$T \leqq (n \pm 1/8) * P$ ($n$ is integer)

wherein "T" denotes a gap between dots formed by the first and the second nozzles neighboring each other, and "P" denotes a pixel value.

21 Claims, 5 Drawing Sheets

INK CARTRIDGE, IMAGE FORMING APPARATUS, AND METHOD TO MANUFACTURE INK CARTRIDGE

CROSS-REFERENCE TO RELATED APPLICATIONS

This application claims priority under 35 U.S.C. §119(a) from Korean Patent Application No. 10-2008-11959, filed on Feb. 5, 2008, in the Korean Intellectual Property Office, the disclosure of which is incorporated herein by reference in its entirety.

BACKGROUND OF THE INVENTION

1. Field of the Invention

The present general inventive concept relates to an ink cartridge of an image forming apparatus, and more particularly, to an ink cartridge which has a plurality of print head chips to jet ink onto a printing medium and print a predetermined image, an image forming apparatus, and a method to manufacture the ink cartridge.

2. Description of the Related Art

In general, an image forming apparatus such as an ink jet printer jets ink onto a desired position of a printing medium, thereby printing an image of a predetermined color on the printing medium.

Such an image forming apparatus includes an ink cartridge which has a plurality of print head chips arranged in a predetermined pattern along an entire width direction of a printing medium to print an image on the printing medium. Ink cartridges are divided into an integral type and a separate type according to how the plurality of print head chips is arranged on a print head substrate.

In the integral type ink cartridge, a plurality of print head chips having a plurality of nozzles to jet ink is integrally formed with the print head substrate. Alternatively, in the separate type ink cartridge, individual print head chips having the plurality of nozzles are separately fabricated and are arranged on a single print head substrate. That is, the integral type ink cartridge and the separate type ink cartridge differ from each other in that respective print head chips thereof having the plurality of nozzles are fabricated integrally and separately.

In the integral type ink cartridge described above, the plurality of print head chips are molded simultaneously and thus gaps between nozzles are constant so that the integral type ink cartridge can produce an image of good quality. However, if one of the print head chips is impaired, an other non-impaired print head chips are useless and thus an efficiency of using the ink cartridge decreases.

As a solution to this problem of the integral type ink cartridge, the separate type ink cartridge removes only an impaired print head chip and replaces the impaired print head chip with a new print head chip.

However, the separate type ink cartridge has a problem that gaps between the plurality of print head chips are misaligned in directions of X or Y with reference to a plane of the print head substrate or in a direction of rotating about a predetermined point. This misalignment between the plurality of print head chips causes a discontinuous area in a color image such as a color band and consequently results in a color leakage, which degrades an image quality.

SUMMARY OF THE INVENTION

The present general inventive concept provides an ink cartridge which corrects a misalignment between a plurality of separately molded print head chips to fall within a predetermined range, thereby preventing image deterioration such as a discontinuous area occurrence in an image, and an image forming apparatus having the same.

Also, the present general inventive concept provides a method to manufacture the above-mentioned ink cartridge.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may also be achieved by providing an ink cartridge including a print head substrate, a first head unit including at least one first print head chip which is disposed on the print head substrate and includes a plurality of first nozzles arranged in plural lines in a second direction perpendicular to a first direction which is a transfer direction of a printing medium, thereby forming a first line in the second direction, and a second head unit including at least one second print head chip which is disposed on the print head substrate and which has an ink jetting area overlapping a predetermined area of the first line, thereby forming an overlapping area, and which includes a plurality of second nozzles arranged in plural lines in the second direction, thereby forming a second line spaced from the first line, wherein dots formed by the first and the second nozzles, which neighbor each other in the overlapping area when jetting ink, have a gap with respect to the first and the second directions within a range satisfying the following equation:

$$T \leqq (n \pm 1/8) * P (n \text{ is integer})$$

wherein "T" denotes a gap between dots formed by the first and the second nozzles neighboring each other, and "P" denotes a pixel value.

If a misalignment value is obtained with reference to the second direction, "n" may equal to 1 in the equation.

If a misalignment value is obtained with reference to the first direction, "n" may equal to 0 in the equation.

If the first and/or the second print head chip is rotated about a predetermined point, a gap of dots formed by the first and the second nozzles in the overlapping area with respect to the first and the second directions may satisfy the equation.

A storage unit to supply ink of at least one color to the first and the second nozzles may be disposed on an other surface of the print head substrate facing one surface where the first and the second head units are disposed.

The foregoing and/or other aspects and utilities of the general inventive concept may also be achieved by providing an image forming apparatus, including an image forming apparatus body having a transfer path for a printing medium formed therein, and an ink cartridge which is disposed in the image forming apparatus body to jet ink onto the printing medium. The ink cartridge includes a print head substrate, a first head unit including at least one first print head chip which is disposed on the print head substrate and includes a plurality of first nozzles arranged in plural lines in a second direction perpendicular to a first direction which is a transfer direction of the printing medium, thereby forming a first line in the second direction, and a second head unit including at least one second print head chip which is disposed on the print head substrate and which has an ink jetting area overlapping a predetermined area of the first line, thereby forming an overlapping area, and which includes a plurality of second nozzles arranged in plural lines in the second direction, thereby forming a second line spaced from the first line, wherein dots formed by the first and the second nozzles, which neighbor each other in the overlapping area when jetting ink, have a gap with respect to the first and the second direction within a range satisfying the following equation:

$$T \leqq (n \pm 1/8) * P (n \text{ is integer})$$

wherein "T" denotes a gap between dots formed by the first and the second nozzles neighboring each other, and "P" denotes a pixel value.

The foregoing and/or other aspects and utilities of the general inventive concept may also be achieved by providing a method for an ink cartridge, the method including preparing a print head substrate, arranging at least one first print head chip on the print head substrate, the first print head chip including a plurality of first nozzles arranged at pixel intervals in plural lines in a second direction perpendicular to a first direction which is a transfer direction of a printing medium, thereby forming a first line in the second direction, arranging at least one second print head chip on the print head substrate, the second print head chip including a plurality of second nozzles arranged at pixel intervals in plural lines in the second direction and forming a second line spaced from the first line such that an ink jetting area of the second print head chip overlaps a predetermined area of the first line, and correcting positions of the first and the second print head chips and fixing the positions such that a gap for the first and the second directions between dots formed by the first and the second nozzles, which neighbor with each other in the overlapping area when jetting ink, satisfies the following equation:

$$T \leqq (n \pm 1/8) * P (n \text{ is integer})$$

wherein "T" denotes a gap between dots formed by the first and the second nozzles neighboring each other, and "P" denotes a pixel value.

The foregoing and/or other aspects and utilities of the general inventive concept may also be achieved by providing an ink cartridge usable with an image forming apparatus, the ink cartridge including a first head unit including a plurality of first nozzles arranged in a plurality of lines in a perpendicular transfer direction perpendicular to a transfer direction of a printing medium to form a first line, and a second head unit including a plurality of second nozzles arranged in a plurality of lines in the perpendicular transfer direction, and having an ink jetting area overlapping a predetermined area of the first line, wherein the first and the second nozzles form dots which neighbor each other in the overlapping area having a gap with respect to the transfer direction and the perpendicular transfer direction corresponding to a pixel value.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
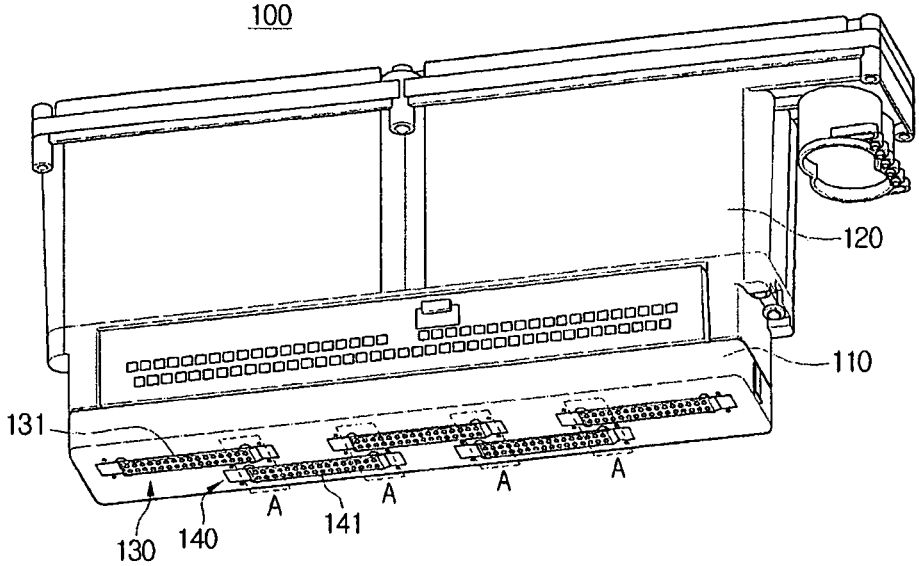
FIG. 1 is a perspective view schematically illustrating an ink cartridge according to an exemplary embodiment of the present general inventive concept.

Reference will now be made in detail to embodiments of the present general inventive concept, examples of which are illustrated in the accompanying drawings, wherein like reference numerals refer to the like units throughout. The embodiments are described below in order to explain the present general inventive concept by referring to the numerals.

Figure 8:
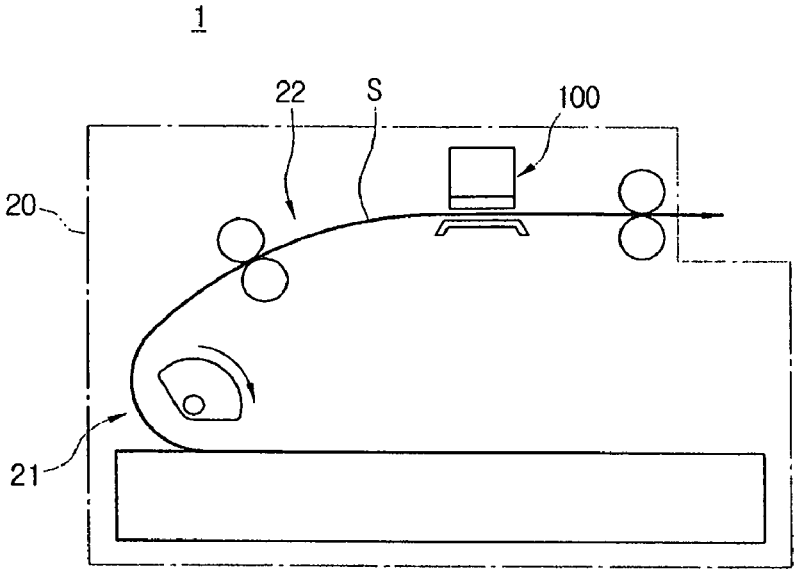
FIG. 8 is a view illustrating an image forming apparatus employing the ink cartridge according to an exemplary embodiment of the present general inventive concept.

Referring to FIG. 8, an image forming apparatus 1 according to an exemplary embodiment of the present general inventive concept includes an image forming apparatus body 20 and an ink cartridge 100.

The image forming apparatus body 20 includes a transfer path through which a printing medium S is transferred. To form the transfer path for the printing medium S, the image forming apparatus body 20 includes various components such as a paper feeding member 21 for feeding and transferring the printing medium S and a transferring member 22. The technical details of the paper feeding member 21 and the transferring member 22 in the image forming apparatus body 20 will be understood from the prior art and thus detailed description and illustration thereof will be omitted.

Referring to FIG. 1, the ink cartridge 100 is disposed in the image forming apparatus body 20 (FIG. 8) to face the transfer path of the printing medium S. As illustrated in FIG. 1, the ink cartridge 100 includes a print head substrate 110 and first and second head units 130 and 140 to print a predetermined color image on the printing medium S.

The print head substrate 110 controls the first and the second head units 130 and 140 to form an image as a user wants to print on the printing medium S. As illustrated in FIG. 1, on one surface of the print head substrate 110 are individually arranged a plurality of head units 130 and 140, and on an other surface of the print head substrate 110 is disposed a storage unit 120 to supply ink of plural colors to the head units 130 and 140. The storage unit 120 contains ink of yellow, magenta, cyan, and black by way of an example.

Figure 2:
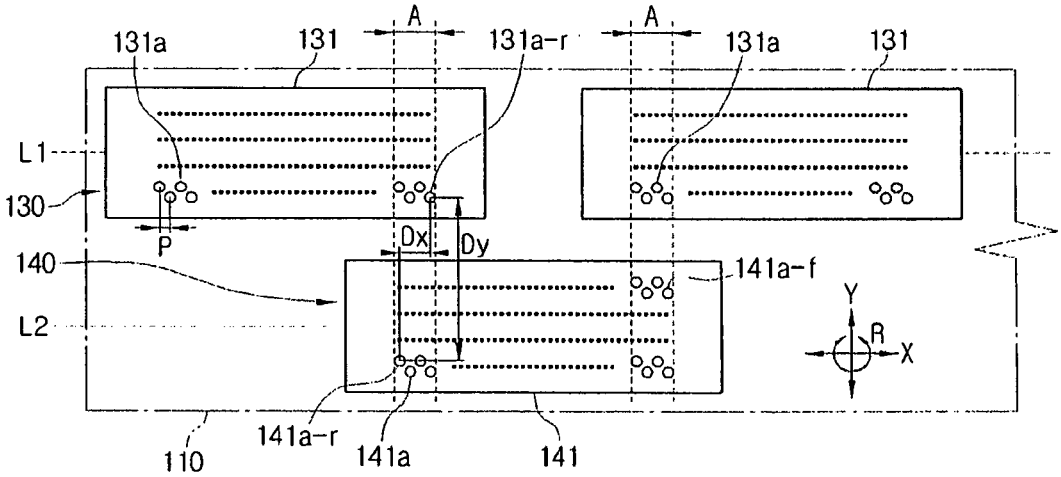
FIG. 2 is a plane view illustrating first and second head units of FIG. 1.

As illustrated in FIGS. 1 and 2, the first head unit 130 includes at least one first print head chip 131 which has a plurality of first nozzles 131*a* to jet ink onto the printing medium S. The first nozzles 131*a* are arranged at predetermined intervals in plural lines with respect to axes X and Y illustrated in FIG. 2. A gap between the plurality of first nozzles 131*a* equals to 1 pixel (P). A magnitude of 1 pixel is determined based on a resolution of the image forming apparatus 1. In this embodiment, 1 P is 1200 dpi (dots per inch) which equals to 1/1200 inch.

The at least one first print head chip 131 of the first head unit 130 are arranged on the print head substrate 110 in line along a second direction (corresponding to a direction of X of FIG. 2) which is perpendicular to a first direction (corresponding to a direction of Y of FIG. 2) which is a transfer direction of the printing medium S, thereby forming a first line L1. In this embodiment, as illustrated in FIG. 1, three first print head chips 131 are individually arranged on the print head substrate 110.

Like the first head unit 130, the second head unit 140 includes at least one second print head chip 141 having a plurality of second nozzles 141*a* to jet ink. Also, the plurality of second nozzles 141*a* are arranged at predetermined intervals in plural lines in first and second directions. A gap between the plurality of second nozzles 141*a* also equals to 1 pixel (P) like the first nozzles 131*a*.

Herein, the second head unit 140 is arranged on the print head substrate 110 in parallel with the first head unit 130 in the second direction and is spaced from the first head unit 130 by a predetermined distance in the first direction, thereby forming a second line L2. The second head unit 140 is arranged on the print head substrate 110 such that first and second direction gaps (Dx, Dy) between a reference second nozzle 141*a-r* of the second print head chip 141 of the second head unit 140 (e.g. the first nozzle 141*a-r* of the first nozzle line of the second print head chip 141) and a reference first nozzle 131*a-r* of the first print head chip 131 of the first head unit 130 (e.g. a last nozzle 131*a-r* of the first nozzle line of the first print head chip 131) are an integer multiple of a gap between the first nozzles 131*a* or the second nozzles 141*a* in the first and the second directions, i.e., are an integer multiple of 1 pixel (P). The gap between the reference first nozzle 131*a-r* and the reference second nozzle 141*a-r* may have a misalignment value of ±⅛*P(error range). Accordingly, the reference second nozzle 141*a-r* of the second head unit 140 arranged on the print head substrate 110 satisfies the following equation 1 with reference to the reference first nozzle 131*a-r* in the first and the second directions:

$$Dx \leqq (a \pm 1/8)*P(a \text{ is integer})$$

$$Dy \leqq (b \pm 1/8)*P(b \text{ is an integer}) \quad \text{[Equation 1]}$$

wherein Dx and Dy denote gaps between the reference first nozzle 131*a-r* and the reference second nozzle 141*a-r* in the second and the first directions, respectively, as illustrated in FIG. 2, and P denotes a pixel value.

Figure 5A:
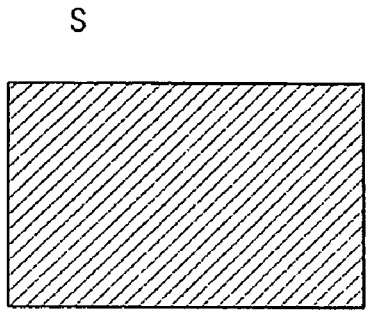
FIGS. 5A through 5C are views illustrating images printed on a printing medium by first and second nozzles which have misalignment values within a range satisfying an equation and out of the range according to an embodiment of the present general inventive concept.
Figure 5B:
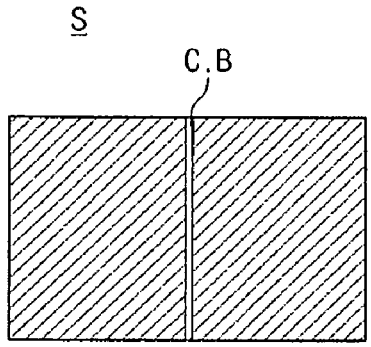

According to above equation 1, a gap between the first nozzle 131*a* of the first line L1 and the second nozzle 141*a* of the second line L2 is not out of a range from an integer multiple of the pixel P to ±⅛ of the pixel P. The value of ±⅛ of the pixel P is a limit that can prevent a color band from being formed on the printing medium S due to a discontinuous area of the image as illustrated in FIG. 5B. Herein, the color band refers to one of areas printed by the print head 100 that does not form an image and exposes a color of the printing medium S.

Four lines of each of the first and the second nozzles 131*a* and 141*a* are arranged in the first direction to correspond to ink of yellow, magenta, cyan, and black.

The first and the second print head chips 131 and 141 of the first and the second head units 130 and 140 are arranged on the print head substrate 110 along an entire width direction of the printing medium S with predetermined overlapping areas A. That is, as illustrated in FIG. 1, two second print head chips 141 are arranged among three first print head chips 131 in an alternating fashion such that four overlapping areas A are formed.

More specifically, as illustrated in FIG. 2, the first and the second print head chips 131 and 141 face each other in the first direction, and a right portion of the first print head chip 131 overlaps a left portion of the second print head chip 141 such that an overlapping area A is formed, and the left of the first print head chip 131 overlaps the right of the second print head chip 141 such that another overlapping area A is formed. A number of overlapping areas A of the first and the second print head chips 131 and 141 increases as a number of the first and the second print head chips 131, 141 on the print head substrate 110 increases.

The first and the second nozzles 131*a* and 141*a*, which neighbor each other in the overlapping areas A of the first and the second print head chips 131 and 141 when jetting ink and forming dots, have a misalignment value less than ⅛P with respect to the first and the second directions. That is, with a reference to a dot formed by ink jetted from the first nozzle 131*a*, a dot formed by ink jetted from the second nozzle 141*a* has a misalignment less than ⅛P with respect to the first and the second directions. Accordingly, a gap between dots respectively formed by ink jetted from the first and the second nozzles 131*a* and 141*b* in the overlapping areas A has a misalignment value of a range satisfying following equation 2:

$$T \leqq (n \pm 1/8)*P(n \text{ is integer}) \quad \text{[Equation 2]}$$

wherein "T" denotes a gap between dots respectively formed by ink jetted from the first and the second nozzles neighboring each other with respect to the first and the second direction, and "P" denotes a pixel value.

Herein, if a gap between dots respectively formed by ink jetted from the first and the second nozzles 131*a* and 141*a* in the overlapping areas A is obtained with reference to the first direction, "n" equals 0 in equation 2, and if the gap is obtained with reference to the second direction, "n" equals 1 in equation 2.

An effect of misalignment between the first and the second nozzles 131*a* and 141*a* in the overlapping areas A with respect to the first and the second directions to an image formed on the printing medium S will now be described with reference to FIGS. 3A through 9C.

Figure 3:
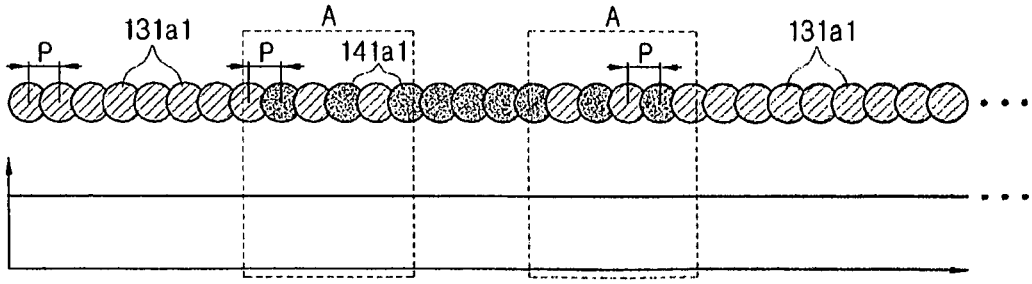
FIG. 3 is a view schematically illustrating dots formed by first and second nozzles which have no misalignment in first and second directions and an image density graph according to an embodiment of the present general inventive concept.

If a gap between the neighboring first and second nozzles 131*a* and 141*a* in the overlapping areas A is an integer multiple of the pixel P in the first and the second directions, a gap between neighboring dots 131*a*1 and 141*a*1 formed by the first and the second nozzles 131*a*, 141*a* in the overlapping areas A equals to 1 pixel (P) as illustrated in FIG. 3 and thus, there is no misalignment in the first and the second directions. In this case, a relative density of an image printed on the printing medium S is constant. Also, in this case, the printed image has no discontinuous area as illustrated in FIG. 5A and a clean image the user desires is printed on the printing medium S.

Figure 4A:
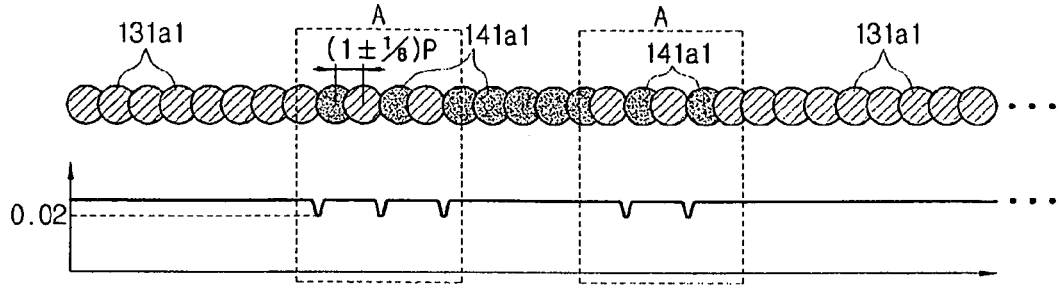
FIG. 4A is a view schematically illustrating dots formed by first and second nozzles which have a misalignment value with respect to a second direction within a range satisfying an equation of the present general inventive concept, and an image density graph.

Also, if a gap between the neighboring first and second nozzles 131*a* and 141*a* in the overlapping areas A is an integer multiple of the pixel P in the first direction but has a misalignment value from an integer multiple to ±⅛P in the second direction, that is, if this gap satisfies Dy=b*P, Dx=(a±⅛)*P, as illustrated in FIG. 4A, a gap between the dots 131*a*1 and

141*a*1 formed by the first and the second nozzles 131*a* and 141*a* in the overlapping areas A with respect to the second direction satisfies equation of (1±⅛)*P. In this case, there is a variation of 0.02 in a relative density of image. This variation falls within a range that does not cause a discontinuous area in the image.

Figure 4B:
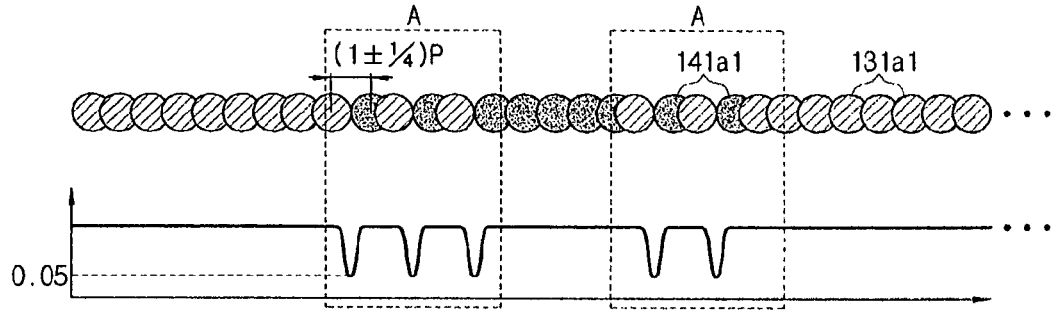
FIGS. 4B and 4C are views illustrating dots formed by first and second nozzles which have misalignment values with respect to a second direction out of a range satisfying an equation of the present general inventive concept, and image density graphs.
Figure 4C:
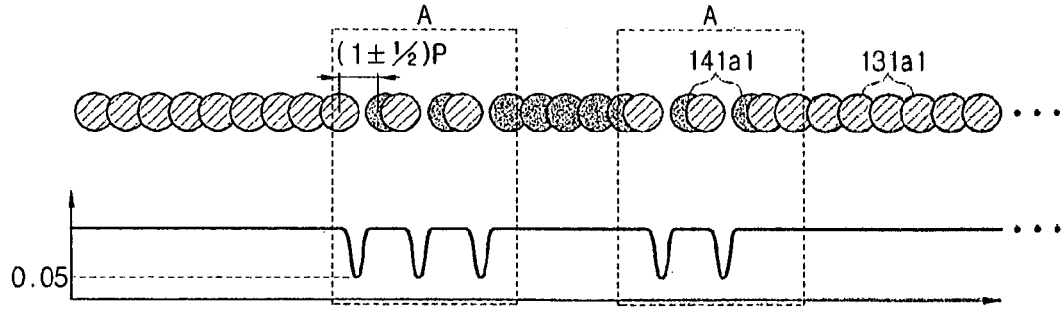

However, if a gap between the neighboring first and second nozzles 131*a* and 141*a* in the overlapping areas A is an integer multiple of the pixel P in the first direction but has a misalignment value from an integer multiple of the pixel P to ±¼P and ±½P in the second direction, that is, if this gap satisfies Dy=b*P, Dx=(a±¼)*P, and Dy=b*P, Dx=(b±½P), as illustrated in FIGS. 4B and 4C, a gap between the dots 131*a*1 and 141*a*1 formed by the first and the second nozzles 131*a* and 141*a* in the overlapping areas A with respect to the second direction satisfies equations of (1±¼)*P and (1±½)*P. In this case, a variation in the relative density of image is 0.05 which is greater than 0.02.

If a variation in the relative density of image is greater than 0.02, a color band indicating a discontinuous area where a color leakage occurs is formed as illustrated in FIG. 5B.

Figure 5C:
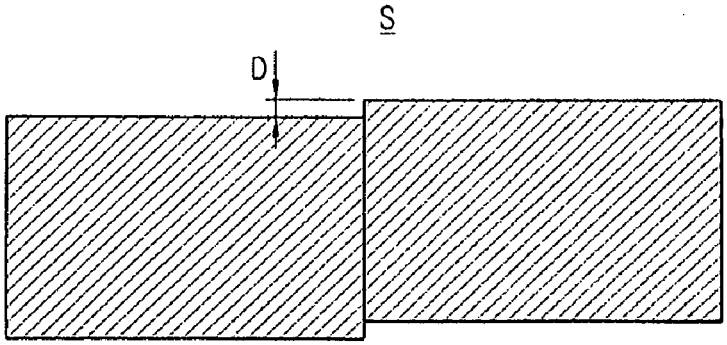
Figure 6:
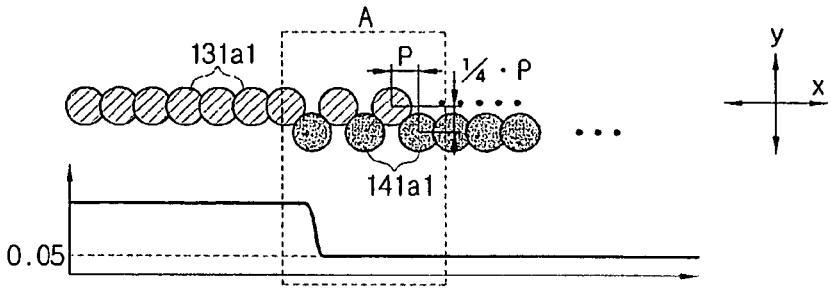
FIG. 6 is a view illustrating dots formed by first and second nozzles which have a misalignment value with respect to a first direction out of a range satisfying an equation and an image density graph according to an embodiment of the present general inventive concept.

Also, as illustrated in FIG. 6, if there is a misalignment in the overlapping area A with respect to the first direction, i.e., a Y-axis direction indicating a transferring direction of the printing medium S, i.e., if a gap between the neighboring first and second nozzles 131*a* and 141*a* in the overlapping areas A is an integer multiple of the pixel P in the second direction but is greater than ±⅛P, in the first direction and thus there is a big misalignment, a variation in the relative density of image is greater than 0.02. FIG. 6 illustrates the case where a gap between the dots 131*a*1 and 141*a*1 formed by the first and the second nozzles 131*a* and 141*a* in the first direction is ¼P and a variation in the density of the image is 0.05. Consequently, there is a discontinuous area where a step D occurs between printed images as illustrated in FIG. 5C.

Meanwhile, even if the first or the second print head chip 131 and 141 rotates in a direction of R with respect to the vertical axis of the print head substrate 110, there is a misalignment between the first or the second nozzles 131*a*', 131*a*", 141*a*' and 141*a*" with respect to the first and the second directions, which are arranged in plural lines in the overlapping area A.

In this case, in order to prevent a color band from being formed on a printing area, the first and the second print head chips 131 and 141 should be arranged such that a gap between the dots 131*a*1 and 141*a*1 formed by ink jetted from the first and the second nozzles 131*a* and 141*a* neighboring each other in the overlapping areas A satisfies a range of (1±⅛)*P with respect to the first and the second directions.

The second print head chip 141 may be arranged, being rotated by a predetermined angle relative to the first print head chip 131. In this case, if the first nozzle 141*a-r* (FIG. 2) of the first nozzle line of the second print head chip 141 is set as an axis of the rotation, the last nozzle 141*a-f* of the fourth nozzle line of the second print head chip 141 has the greatest misalignment value. Accordingly, if the second print head chip 141 is rotated by a predetermined angle even in the case where the first nozzle 141*a-r* of the first nozzle line of the second print head chip 141 is located at a position corresponding to an integer multiple of the pixel P (Dx=a*P, Dy=b*P) from the last nozzle 131*a-r* of the first nozzle line of the first print head chip 131, the other second nozzles 141*a* of the second print head chip 141 are misaligned and the last nozzle 141*a-f* of the fourth nozzle line of the second print head chip 141 has the greatest misalignment value.

Hereinafter, referring to FIGS. 7A to 7C, an effect of a rotation error which occurs in arranging the second print head chip 141 to an image formed on the printing medium S will now be described.

However, in the following descriptions, the second print head chip 141 is arranged such that the last nozzle 131*a-r* of the first nozzle line of the first nozzles 131*a* of the first print head chip 131 and the first nozzle 141*a-r* of the first nozzle line of the second nozzles 141*a* of the second print head chip 141 coincide with each other in relative positions thereof in the directions of X and Y, that is, the first nozzle 141*a-r* of the first nozzle line of the second nozzles 141*a* of the second print head chip 141 is located at a position corresponding to an integer multiple of the pixel P (Dx=a*P, Dy=b*P) at the last nozzle 131*a-r* of the first nozzle line of the first nozzles 131*a* of the first print head chip 131, but a predetermined rotation error occurs.

Figure 7A:
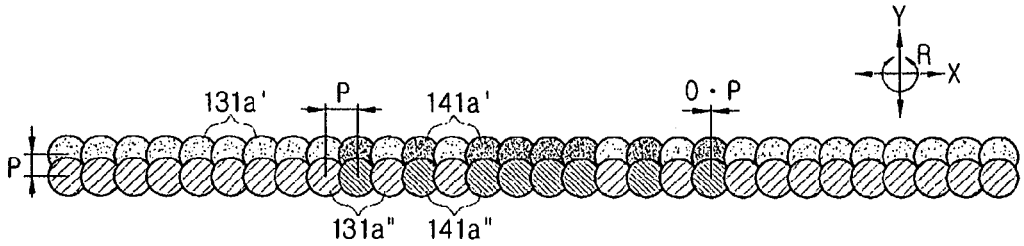
FIGS. 7A through 7C are views illustrating first and second nozzles line gaps of which are misaligned with respect to first and the second directions.

FIG. 7A illustrates dots 131*a*', 131*a*", 141*a*' and 141*a*" formed by the first and the second nozzles 131*a* and 141*a* if there is no rotation error in the second print head chip 141.

In this case, as illustrated in FIG. 7A, a gap between the dots 131*a*', 131*a*", 141*a*' and 141*a*" formed by the first and the second nozzles 131*a* and 141*a* corresponds to a pixel value of (1*P) in the first and the second directions and thus there is no misalignment. In this case, since a relative density of an image printed on the printing medium S is constant, the printed image has no discontinuous area as illustrated in FIG. 5A and a clean image the user desires is printed on the printing medium S.

Figure 7B:
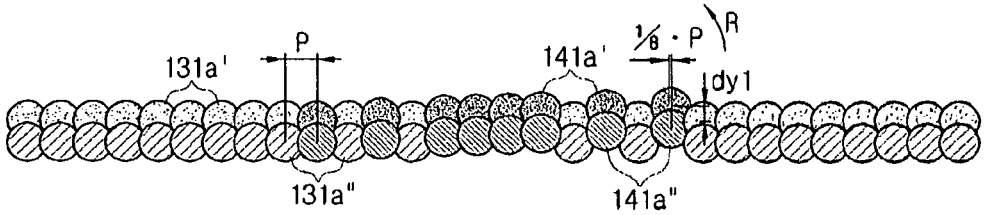
Figure 7C:
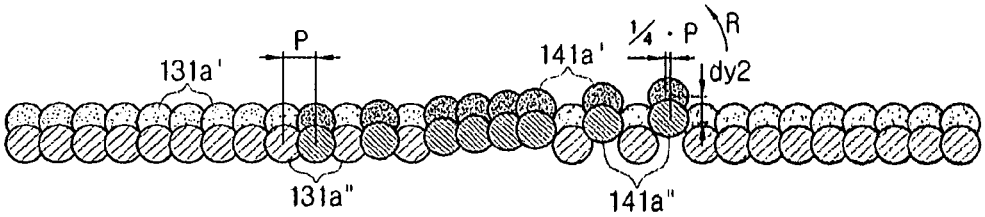

FIGS. 7B and 7C illustrate the case where, as the second print head chip 141 is rotated by a predetermined angle, dots 131*a*', 131*a*", 141*a*', 141*a*" formed by ink jetted from the first and the second nozzles 131*a*, 141*a* are rotated right side up i.e. in the direction of R. There is a misalignment in the dots 141*a*', 141*a*" formed by the second nozzle 141*a* of the second print head chip 141 (FIG. 2) in the first and the second direction. That is, there is no misalignment between the dots 131*a*', 131*a*" formed by the first nozzles 131*a* of the first print head chip 131 with respect to the first and the second directions, and there is a misalignment of the dots 141*a*' and 141*a*" formed by the second nozzle 141*a* with respect to the dots 131*a*' and 131*a*" formed by the first nozzle 131*a* in the first and the second directions.

Referring to FIGS. 2 and 7B, a gap between the dots formed by the reference first and second nozzles 131*a-r* and 141*a-r* which coincide with each other in relative positions thereof is 1 pixel (P), and a second direction gap between upper and lower dots formed by an outermost nozzle 141*a-f* of the second nozzles 141*a* of the second print head chip 141 falls within ⅛*P. Also, a first direction gap between a dot formed by the outermost nozzle 141*a-f* of the second nozzles 141*a* and a dot formed by the first nozzle 131*a* is dy1. Herein, the outermost nozzle 141*a-f* of the second nozzles 141*a* of the second print head chip 140 refers to a second nozzle 141*a* that is farthest located from the reference second nozzle 141*a-r*.

Referring to FIGS. 2 and 7C, the second print head chip 141 is further rotated from that of FIG. 7B, and a gap between the dots formed by the reference first and the second nozzles 131*a-r* and 141*a-r* is 1 pixel (P) and a second direction gap between upper and lower dots formed by the outermost nozzle 141*a-f* of the second nozzles 141*a* of the second print head chip 141 is ¼*P. Also, a first direction gap between a dot formed by the outermost nozzle of the second nozzles 141*a* and a dot formed by the first nozzle 131*a* is dy2, which is greater than dy1.

If an image is printed by the second nozzles 141*a* having the misalignment value, i.e., if dots 131*a*', 131*a*", 141*a*' and 141*a*" of the first and the second directions has a misalignment value less than ±⅛P as illustrated in FIG. 7B, a variation in a relative density of image is 0.02, which does not cause a color band. However, if a misalignment of the dots 131*a*', 131*a*", 141*a*' and 141*a*" in the first and the second directions is greater than ±⅛P as illustrated in FIG. 7C, a variation in the relative density of image is 0.05, which causes a color band as illustrated in FIG. 5B.

Hereinafter, a method to manufacture the ink cartridge of the image forming apparatus described above will be described.

An operator such as an operating robot prepares the print head substrate 110 on a work place. After that, the operator arranges the first print head chip(s) 131 on the print head substrate 110 to form the first line L1 in the second direction.

Also, the operator arranges the second print head chip(s) 141 having the second nozzles 141*a* among the first print head chip(s) 131 as illustrated in FIGS. 1 and 2, such that an ink jetting area of the second print head chip(s) 141 overlaps that of the first print head chip(s) 131. Accordingly, the second print head chip(s) 141 forms the second line L2 spaced from the first line L1 and in lines in the second direction.

If the first and the second print head chips 131 and 141 are arranged on the print head substrate 110, the operator corrects positions of the first and the second print head chips 131, 141 and fixes the positions such that misalignment values for the first and the second directions between the first and the second nozzles 131*a* and 141*a*, which neighbor each other in the overlapping areas A of the first and the second print head chips 131 and 141 when jetting ink, are less than ±⅛P.

To correct the misalignment between the first and the second print head chips 131 and 141 with respect to the first and the second directions, relative coordinate values of the first and the second print head chips 131 and 141 are used. Technical details of correcting positions of components using the coordinate values are well known in the prior art and thus detailed description and illustration will be omitted.

An operation of correcting the misalignment between the first and the second print head chips 131 and 141 with respect to the first and the second direction is applied to all of the first and the second print head chips 131 and 141 arranged on the print head substrate 110.

Although in this embodiment the above equation is described on the assumption that the misalignments occur in any one of the overlapping areas A of the first and the second print head chips 131 and 141, with reference to the first and the second directions in any direction of first, second, and R, this should not be considered as limiting. A notion that the misalignment value is less than ±⅛P, which is one of technical features of the present general inventive concept, can be applied to the case where misalignment occurs in multi directions in the plurality of overlapping areas.

According to an ink cartridge, an image forming apparatus, and a method to manufacture the ink cartridge, a plurality of print head chips are individually arranged on a print head substrate such that the print head chips have a misalignment value for a transfer direction and/or a transverse direction in the overlapping areas A satisfying an equation, which is obtained in consideration of a range which does not cause a discontinuous area in the image. Consequently, printing quality degradation such as a color band indicating a color leakage or a step in the image is prevented. Therefore, an accurate image can be printed on the printing medium based on input print data and thus an image quality is improved.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An ink cartridge, comprising:

a print head substrate;

a first head unit comprising at least one first print head chip which is disposed on the print head substrate and comprises a plurality of first nozzles arranged in plural lines in a second direction perpendicular to a first direction which is a transfer direction of a printing medium, thereby forming a first line in the second direction; and a second head unit comprising at least one second print head chip which is disposed on the print head substrate and which has an ink jetting area overlapping a predetermined area of the first line, thereby forming an overlapping area, and which comprises a plurality of second nozzles arranged in plural lines in the second direction, thereby forming a second line spaced from the first line, wherein dots formed by the first and the second nozzles, which neighbor each other in the overlapping area when jetting ink, have a gap with respect to the first and the second directions within a range satisfying the following equation:

$$T \leqq (n \pm 1/8) * P \text{ (} n \text{ is integer)}$$

wherein "T" denotes a gap between dots formed by the first and the second nozzles neighboring each other, and "P" denotes a pixel value.

2. The ink cartridge as claimed in claim 1, wherein, if a misalignment value is obtained with reference to the second direction, "n" equals 1 in the equation.

3. The ink cartridge as claimed in claim 1, wherein, if a misalignment value is obtained with reference to the first direction, "n" equals 0 in the equation.

4. The ink cartridge as claimed in claim 2, wherein, if a misalignment value is obtained with reference to the first direction, "n" equals 0 in the equation.

5. The ink cartridge as claimed in claim 3, wherein, if the first and/or the second print head chip is rotated about a predetermined point, a gap of dots formed by the first and the second nozzles in the overlapping area with respect to the first and the second directions satisfies the equation.

6. The ink cartridge as claimed in claim 4, wherein, if the first and/or the second print head chip is rotated about a predetermined point, a gap of dots formed by the first and the second nozzles in the overlapping area with respect to the first and the second directions satisfies the equation.

7. The ink cartridge as claimed in claim 1, wherein a storage unit to supply ink of at least one color to the first and the second nozzles is disposed on an other surface of the print head substrate facing one surface where the first and the second head units are disposed.

8. An image forming apparatus, comprising:

an image forming apparatus body having a transfer path for a printing medium formed therein; and an ink cartridge which is disposed in the image forming apparatus body to jet ink onto the printing medium, the ink cartridge comprises:

a print head substrate;

a first head unit comprising at least one first print head chip which is disposed on the print head substrate and comprises a plurality of first nozzles arranged in plural lines in a second direction perpendicular to a first direction which is a transfer direction of the printing medium, thereby forming a first line in the second direction; and a second head unit comprising at least one second print head chip which is disposed on the print head substrate and which has an ink jetting area overlapping a predetermined area of the first line, thereby forming an overlapping area, and which comprises a plurality of second nozzles arranged in plural lines in the second direction, thereby forming a second line spaced from the first line, wherein dots formed by the first and the second nozzles, which neighbor each other in the overlapping area when jetting ink, have a gap with respect to the first and the second direction within a range satisfying the following equation:

$T \leqq (n \pm 1/8) * P$ ($n$ is integer)

wherein "T" denotes a gap between dots formed by the first and the second nozzles neighboring each other, and "P" denotes a pixel value.

9. The image forming apparatus as claimed in claim 8, wherein, if a misalignment value is obtained with reference to the second direction, "n" equals 1 in the equation.

10. The image forming apparatus as claimed in claim 8, wherein, if a misalignment value is obtained with reference to the first direction, "n" equals 0 in the equation.

11. The image forming apparatus as claimed in claim 9, wherein, if a misalignment value is obtained with reference to the first direction 1, "n" equals 0 in the equation.

12. The image forming apparatus as claimed in claim 10, wherein, if the first and/or the second print head chip is rotated about a predetermined point, a gap of dots formed by the first and the second nozzles in the overlapping area with respect to the first and the second directions satisfies the equation.

13. The image forming apparatus as claimed in claim 11, wherein, if the first and/or the second print head chip is rotated about a predetermined point, a gap of dots formed by the first and the second nozzles in the overlapping area with respect to the first and the second directions satisfies the equation.

14. The image forming apparatus as claimed in claim 8, wherein a storage unit to supply ink of at least one color to the first and the second nozzles is disposed on an other surface of the print head substrate facing one surface where the first and the second head units are disposed.

15. A method for an ink cartridge, the method comprising:

preparing a print head substrate;

arranging at least one first print head chip on the print head substrate, the first print head chip comprising a plurality of first nozzles arranged at pixel intervals in plural lines in a second direction perpendicular to a first direction which is a transfer direction of a printing medium, thereby forming a first line in the second direction;

arranging at least one second print head chip on the print head substrate, the second print head chip comprising a plurality of second nozzles arranged at pixel intervals in plural lines in the second direction and forming a second line spaced from the first line such that an ink jetting area of the second print head chip overlaps a predetermined area of the first line; and correcting positions of the first and the second print head chips and fixing the positions such that a gap for the first and the second directions between gaps formed by the first and the second nozzles, which neighbor each other in the overlapping area when jetting ink, satisfies the following equation:

$T \leqq (n \pm 1/8) * P$ ($n$ is integer)

wherein "T" denotes a gap between dots formed by the first and the second nozzles neighboring each other, and "P" denotes a pixel value.

16. The method as claimed in claim 15, wherein, in the correcting positions operations, if the misalignment value is obtained with reference to the second direction, "n" equals to 1 in the equation.

17. The method as claimed in claim 15, wherein, in the correcting positions operations, if the misalignment value is obtained with reference to the first direction, "n" equals to 0 in the equation.

18. The method as claimed in claim 16, wherein, in correcting positions operations, if the misalignment value is obtained with reference to the first direction, "n" equals to 0 in the equation.

19. The method as claimed in claim 17, wherein, in correcting positions operations, if the first and/or the second print head chip is rotated about a predetermined point, a gap of dots formed by the first and the second nozzles in the overlapping area with respect to the first and the second directions satisfies the equation.

20. The method as claimed in claim 18, wherein, in correcting positions operations, if the first and/or the second print head chip is rotated about a predetermined point, a gap of dots formed by the first and the second nozzles in the overlapping area with respect to the first and the second directions satisfies the equation.

21. The method as claimed in claim 15, wherein the preparing operation comprising:

preparing a storage unit to supply ink of at least one color to the first and the second nozzles on the other surface of the print head substrate facing one surface where the first and the second head units are disposed.

* * * * *